US007677407B2

(12) United States Patent
Davis

(10) Patent No.: US 7,677,407 B2
(45) Date of Patent: Mar. 16, 2010

(54) INSULATED BEVERAGE HOLDER WITH VERTICAL BRACKET AND FLAT STORAGE METHOD

(76) Inventor: Christine M. Davis, 340 Shore Rd., Venice, FL (US) 34285

( * ) Notice: Subject to any disclaimer, the term of this patent is extended or adjusted under 35 U.S.C. 154(b) by 157 days.

(21) Appl. No.: 12/033,920

(22) Filed: Feb. 20, 2008

(65) Prior Publication Data

US 2009/0206099 A1 Aug. 20, 2009

(51) Int. Cl.
*A47J 41/00* (2006.01)
*B65D 81/38* (2006.01)
*B65D 25/20* (2006.01)

(52) U.S. Cl. ..... 220/739; 220/478; 220/781; 220/592.17; 220/592.24

(58) Field of Classification Search ..... 220/737, 220/739, 480, 481, 478, 592.17, 592.24; 248/231.91, 311.2
See application file for complete search history.

(56) References Cited

U.S. PATENT DOCUMENTS 4,088,250 A * 5/1978 Schaefer ..... 224/235
4,194,627 A 3/1980 Christensen
4,372,453 A 2/1983 Branscum
4,648,525 A * 3/1987 Henderson ..... 220/739
4,681,239 A 7/1987 Manns et al.
4,871,597 A * 10/1989 Hobson ..... 428/36.1
4,957,254 A 9/1990 Hill et al.
5,251,777 A * 10/1993 McMahon ..... 220/480
5,279,452 A 1/1994 Huynh
5,325,991 A 7/1994 Williams
5,445,315 A 8/1995 Shelby
5,870,969 A * 2/1999 Boyce ..... 119/61.3
5,947,322 A * 9/1999 Ho ..... 220/477
6,655,543 B2 12/2003 Beuke
2001/0027979 A1 10/2001 Canfield
2002/0125262 A1 9/2002 Canfield
2005/0103959 A1* 5/2005 Lee ..... 248/223.41
2006/0201956 A1* 9/2006 Romo ..... 220/737
2007/0017924 A1* 1/2007 Hundley ..... 220/737
2007/0084236 A1* 4/2007 Panganiban ..... 62/457.3
2007/0138188 A1* 6/2007 Mace et al. ..... 220/739
2007/0181617 A1 8/2007 Ramsey
2008/0179341 A1* 7/2008 Kozel et al. ..... 220/737
2009/0050766 A1* 2/2009 Scarton et al. ..... 248/311.2

* cited by examiner

*Primary Examiner*—Anthony Stashick
*Assistant Examiner*—Niki M Eloshway
(74) *Attorney, Agent, or Firm*—Dennis G. LaPointe

(57) ABSTRACT

A beverage holder device made from a flexible foldable cylindrically-shaped insulated sleeve with a longitudinal seam that includes a piping or welt material along said seam. The sleeve has an inside diameter sized to receive and hold a beverage container. An elongated bracket is mountable to a vertical surface. The sleeve has a foldable insulated bottom portion which is attached to the sleeve to prevent the beverage container from dropping through the sleeve. The bracket has a longitudinal channel and a corresponding opening therein with a closed bottom end and an opening at its upper end. The channel is sized to receive by sliding engagement therein the piping or welt material so that when the piping or welt material is slid into the channel starting from the channel's upper end, the piping or welt material and the sleeve are held in place by the bracket.

11 Claims, 14 Drawing Sheets

INSULATED BEVERAGE HOLDER WITH VERTICAL BRACKET AND FLAT STORAGE METHOD

FIELD OF THE INVENTION

The invention relates to a manufactured soft insulated beverage drink holder that has integral parts whereby the insulated sleeve functions with a streamline bracket mounted on a vertical surface and holds a can beverage in an upright position in use and when not in use folds flat for storage.

BACKGROUND OF THE INVENTION

A disadvantage of some prior art related devices has been that the holder is separate from the insulated sleeve thus requiring the holder to be constructed of rigid plastic or metal and encasing the insulated drink holder. In other prior art devices, the disadvantage of a number of beverage holders has been the rigid materials from which they are constructed to hold a beverage container in a generally upright orientation however in the outdoor recreation environment rigid holders can get in the way and can be broken or damaged when bumped.

Prior art devices which are large rigid holders require four times more retail space for each drink holder.

In addition, many prior art drink holders are made with metal materials that rust in a salt water or exterior environment.

None of the prior art devices contain an insulated drink holder and bracket combination that collapses to a flat position for storage with the insulated drink holder in place. Further, prior art drink holders do not integrate an insulated sleeve with the mounted bracket, and do not mount in a manner to allow the decorative ornamentation to be displayed when the device is in a stored position.

SUMMARY OF THE INVENTION

The invention is in general a flexible and foldable insulated beverage drink holder that receives a beverage, such as soda or beer, and when placed in the mounted device holds the beverage in an upright position. The insulated holder sleeve, when not in use, can be placed in the mount device, also referred to herein as a receptacle or storage portion, of the invention and folded to a flat storage position.

The insulated drink holder can be made from a variety of materials known in the art and is preferably made of a fabric tubular shell surrounding an insulated material, with a single seam from the top to the bottom on one side of the tubular shell or cylindrical portion and a welt strip or piping sewn or otherwise incorporated into the outside of this seam for the purpose of mounting the drink holder into a vertical bracket with a channel. The piping or welt is configured to slide through a slotted elongated holder receptacle (shaped similar to PVC awning rails).

A thin closed-cell insulation with reflective surface is the preferred insulative material for construction of the insulated beverage holder. The product design and materials used reduce the flow of heat to the beverage container by limiting the conductive, convective and radiate heat transfer. The reduction in heat transfer also minimizes the occurrence of condensation on the beverage container, for example, a can, a bottle, or a cup containing a beverage. Other thin insulative materials can be used as an alternate and would not constitute a variation from the scope of the present invention. The entire device is made of materials known in the art that are suitable for the application. When exterior use of the invention is necessary, sun, mildew and rust resistant materials are used.

An insulated bottom piece is attached at the bottom of the tubular shell and prevents the beverage container from passing through the drink holder. This bottom piece need not be attached around the total of the perimeter of the sleeve bottom, but instead may preferably be attached at two sides. This latter feature allows for the bottom piece to be sewn into the bottom seam on one side of the sleeve and a hook and loop fastener to be incorporated on the opposite side. This then allows the bottom piece to be adjusted for the beverage container size and hold the full beverage container above any flat horizontal surface the sleeve is placed on when in use.

The insulated bottom piece is constructed to fold up and inside the tubular insulated sleeve for storage. Top stitching on the interior side of the bottom piece promotes folding up and the collapse of the drink holder to a flat position when not in use.

The bottom piece is preferably stitched into the top of the bottom seam which elevates the base and creates an air space between the drink holder bottom and any flat horizontal surface that the beverage holder is placed on, like a table. This air space reduces conductive heat transfer to the beverage container.

The flexible bottom piece allows the can beverage to be easily pushed up from the bottom to remove the beverage container.

The protruding beaded edge of the welt strip incorporated into the side seam of the holder, slips into the larger open end of a channel on the vertical mounted bracket, that is, it is configured to slide through a slotted elongated holder receptacle as noted above.

The welt strip has a plurality of selectable means to create a beaded edge that can slip into the channel and hold the insulated sleeve in a vertical position including welt material, fabric covered piping, decorative beading or other applied trim that can slide into the channel and serve the same purpose.

The beaded edge when placed in the bracket channel can hold a beverage in an upright vertical position. The base of the vertical bracket channel is sealed or otherwise closed to prevent the welt or piping from passing through the bracket.

The low profile vertical bracket can be secured to any vertical surface using a plurality of selectable mounting methods whereby the user may select the means most appropriate to the use and surface on which the vertical bracket is mounted. The vertical bracket mounting means includes: adhesive, adhesive tape, screws, bolts, rivets, industrial adhesive, adhesive hook and loop fastening method, or other similar means. The method suitable based on the application can be determined by the user.

The invention is contemplated for use on boats, recreational vehicle, golf cart, auto, attached to a ice cooler, lunch box, back pack, mounted inside a kitchen cabinet, and compact enough for possible sale in a vending machine.

An alternate size bracket when made longer in length can be used for storage of several stacked insulated drink holders. This alternate use allows compact storage where that is the desired main desired function of the bracket. Used in this manner, the bracket may be mounted inside a cabinet door for household use. The extended length vertical bracket mounting means includes: adhesive, adhesive tape, screws, bolts, rivets, industrial adhesive, adhesive hook and loop fastening method, or other similar means.

The insulated beverage holder, when placed in the vertical channel and not in use, will fold to a flat position for storage. When in the storage position, a fastening device on the rear side of the drink holder will secure it in the flat position. The fastening system has a plurality of selectable means, whereby the user may select that means most appropriate to the vertical surface on which the holder is mounted including: hook and loop fastener, magnetic, snap or other similar methods.

The features of this invention allows for high functional quality, compact shipping and minimal retail space when compared to prior art. The large area on one side of the insulated beverage sleeve allows for decorative ornamentation that is highly visible when in the stored position.

A thin construction allows the invention to fit comfortably in a female or childs hand and the size is functional with most car and boat drink holder cup space. The small mounting bracket and soft insulated sleeve is safer for use in moving vehicles.

In summary, according to the present invention, the above mentioned deficiencies of the prior art are corrected with the present invention that provides dual purpose use, an insulated sleeve with a welt strip that functions to keep the beverage container cold and the welt strip also serves as an integral part of the drink holder system when placed in the vertical bracket.

The drink holder device is pliable and can fold flat when not in use. The drink holder bracket is slimline and can be mounted securely with adhesive (which is most desirable to many boat owners), screws, bolts, rivets and hook and loop adhesive fastener. This drink holder and bracket consumes minimum space when installed. The flat insulative sleeve when in the stored position provides a surface for ornamentation. For exterior use it is constructed of marine industry materials to hold up in the exterior elements, floats and will not rust.

The present invention when packaged also requires minimal space on the retail shelf which allows retail businesses to stock two to four times the inventory of the typical rigid drink holders.

The various features of the present invention are characterized and pointed out in the appended claims. For a better understanding of the invention and the operational advantages, reference the accompanying drawings and descriptive matter related to the present invention.

The present invention overcomes the disadvantages of the above prior art beverage container insulating devices by providing an insulated sleeve and holder devise with low profile mounting bracket. The drink holder is flexible and resistant to the exterior environment. The present invention provides for insulation of a beverage container and a method to mount the insulated drink holder in a vertical position when used with the vertical bracket. The invention has a fastening system on the rear side that holds the invention in a flat compact storage position. The fastening device can be one of a plurality of means appropriate for the end use including hook and loop fasteners, magnetic, snap, etc.

A further advantage of the present invention is that the device is very compact for shipping and retail display. Still another advantage is that the invention is constructed with materials used in exterior or marine industry that have proven resistant to sunlight, mildew, saltwater and has insulation characteristics that allow it to float.

In summary, some of the typical and/or preferred features of the invention are as follows:

1. A flexible and foldable insulated beverage holder device that receives a beverage container such as a can, bottle or cup and functions integrally with a mounting bracket.

2. The insulated beverage holder is made of material sewn into a cylindrical shape with one side seam that is stitched with the bead of welt material protruding toward the back side due to the fold of the seam selvage and therefore lying against the circular sleeve when in use. The described method of stitching the seam is the preferred method, however, there are several optional method of stitching the seam that are not considered to be a material difference.

3. Closed cell insulation with reflective surfaces on both sides is preferred. The insulation is located between the layer of the outer fabric and the interior fabric liner. The interior fabric liner is optional but when used creates a higher quality product. For more inexpensive product manufacturing, the liner can be eliminated without significantly changing the device.

4. The insulation located within the tubular fabric sleeve can be constructed of a plurality of materials available on the market. Selection of insulation is made based on the intended use, i.e., in a marine environment a closed-cell foam with reflective surface is appropriate and allows the device to float in the water.

5. Insulation with reflective surfaces on both the interior and exterior is preferred but as an option, a single sided exterior reflective surface on the insulation can be used.

6. The beaded edge or welt strip located on the side seam is used to slide the insulated beverage holder into a channel on the vertical bracket and secure the beverage holder in a vertical position.

7. The outside layer of the insulated beverage holder has a fastener located on the back side to secure the beverage holder flat for storage. The fastener can be a plurality of means including hook and loop fasteners, magnetic, snap, clips or other similar means.

8. An open hook fastener is mounted to the vertical surface of a boat, cooler, inside cabinet door, on outdoor furniture or other, near where the bracket is mounted. This hook fastener secures to the loop piece on the back side of the insulated beverage holder to allow the beverage holder to be stored in a flat position against the vertical surface. Other methods of securing may include a snap, clips, magnet, or similar means.

9. The flexible insulated beverage holder when not use, can be collapsed and folded to one side of the bracket mount and secure to a flat surface with the use of a fastening device such as hook and loop fastener. The device would be held in a flat storage position.

10. A soft insulated beverage holder with a vertical bracket and flat storage method is comprised of insulation surrounded by fabric materials made to hold a cylindrical can, bottle or cup is constructed into a sleeve (cylindrical) shape with a single side seam and a piece of welt material sewn in the side seam.

11. The bottom of the cylindrical shape beverage holder is semi-enclosed with a circular piece of insulation with reflective surface and fabric attached with a tab on the opposite sides of the bottom of the cylindrical shape. The attachment on two side can be, sewn, hook and loop, snap or other means or a combination of methods.

12. The bottom piece is stitched to promote the folding upward into the insulated sleeve.

13. The bottom piece is sized and attached at the bottom seam, approximately ½" above the bottom of the drink holder thereby holding the beverage above any surface it is rested on and reducing conductive heat transfer.

14. The preferred method of attaching the bottom insulation is stitched at the tab on one side and the other uses a fastening system such as hook and loop fastener.

15. The vertical bracket must be mounted in a vertical position with any one of several optional methods including two screws, adhesive, adhesive tape, adhesive hook and loop fastener, bolts, rivets, straps or other similar methods.

16. The bracket can be secured to any flat vertical surface. Mounting the bracket on a vertical surface is essential to allow the beverage to be held in an up right vertical position.

17. The top of the bracket channel is open and slightly larger than the welt. The top is rounded and tapered to easily accept the welt attached to the insulated holder.

18. The vertical bracket is sealed at the base of the bracket which acts as a stop for the welt strip located on the insulated beverage holder and prevents the welt from passing through the channel.

19. The bracket can be constructed in various lengths depending on the primary function of the bracket for the application used. A bracket that is constructed at a length to hold one or more beverage holders in a stacked position is an alternative embodiment contemplated by the invention herein.

20. The construction of this beverage holder device with materials typically used in an exterior marine environment provides for excellent sun, mildew and rust resistance when desired for exterior application.

21. This insulated beverage holder device is particularly adopted to fit over the external surface of a generally cylindrical beverage cans, bottles or cups and accept decorative ornamentation on one side.

22. This device can be constructed in a mirror image to provide for the bracket to be placed in a similar position on opposite sides of vehicles or furnishings which have symmetrical design like boats, golf carts or ice coolers.

23. To remove the beverage container from the holder, simply push the beverage container up from the bottom while holding the device.

While there is shown and described herein a certain specific structure embodying this invention, it is understood that variations, modifications and rearrangements of the folds or parts may be made without departing from the scope or spirit of the underlying inventive concept and including such departures from the present disclosure as come within known or customary practice in the art to which this invention pertains and fall within the limits of the appended claims.

BRIEF DESCRIPTION OF THE DRAWINGS

The features and advantages of the present invention will be more readily understood from the following detailed description when read in conjunction with the accompanying drawings.

DETAILED DESCRIPTION OF THE INVENTION

Figure 1:
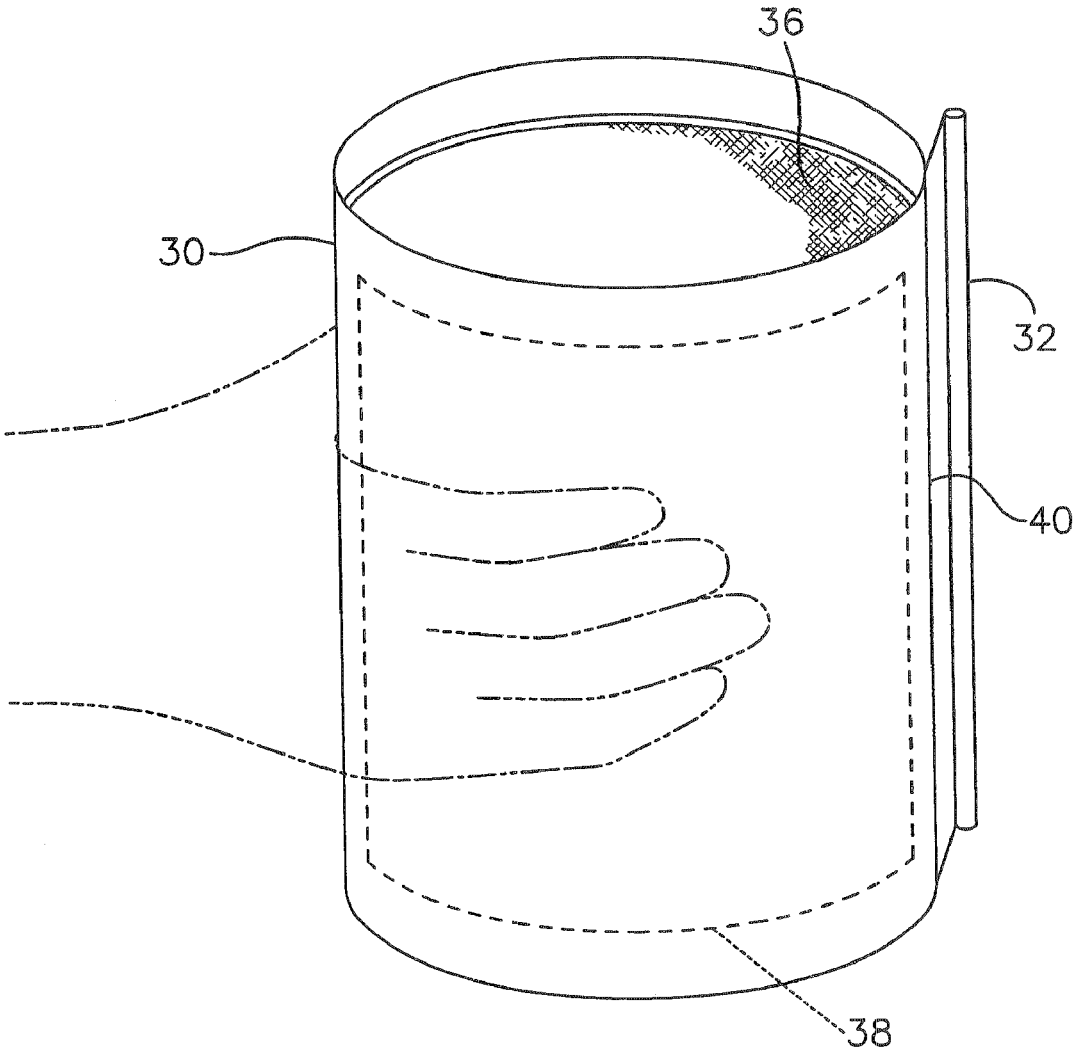
FIG. 1 is a front perspective conceptual view of the insulative sleeve portion of the invention.

In the description which follows, like parts are marked throughout the specifications and drawings. The drawings are not necessarily to scale and in some instances, proportions have been exaggerated in order to more clearly depict certain features of the invention.

Referring to FIGS. 1-6, the present invention is an insulating device that includes an insulated beverage holder or sleeve 30 made of a flexible material appropriate for use. For exterior use, a sun resistant textile material, such as acrylic woven textile material is preferred for making the sleeve 30. A combination of materials can be used with a lighter weight fabric on the inside liner 36 to reduce cost and improve function. The inside liner 36 covers an insulating material such as a closed cell insulative foam 42 with a reflective surface or film 41,43 on the external and/or internal surfaces of the closed cell insulation 42. This is the preferred insulation because such a material floats, does not absorb moisture and has good insulative qualities to reduce conductive heat transfer. The reflective surface of the insulation reduced heat transfer through thermal radiation.

A seam 40 on one side of the insulated sleeve 30 has a welt strip or piping 32 sewn or otherwise incorporated into it for purpose of mounting the holder or sleeve 30 to the bracket 50 in a vertical position. The method of creating the side seam 40 can vary but it is essential that the beaded edge of the welt 32 to lay closely against the side of the insulated sleeve 30 when in use. This allows the insulated holder 30 to be held in either hand comfortably.

Figure 11:
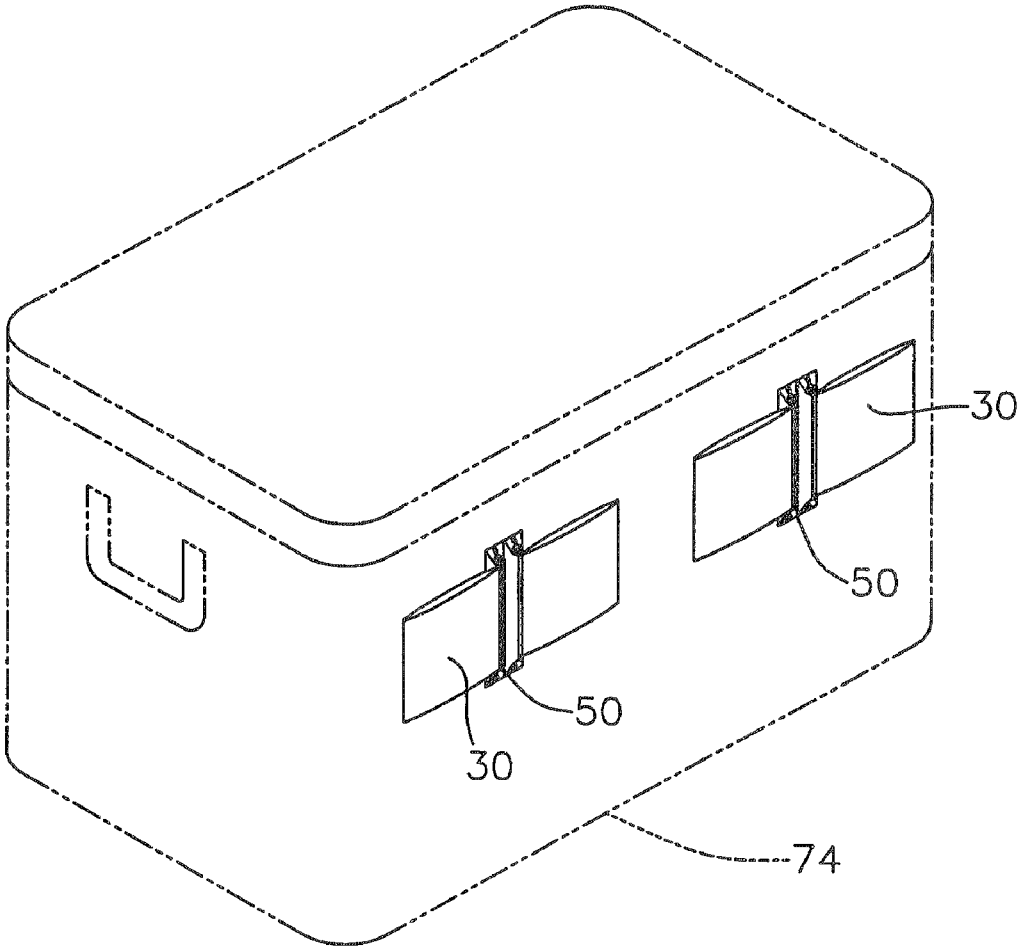
FIG. 11 depicts an example of double mounted drink holders in use with a large cooler.
Figure 12:
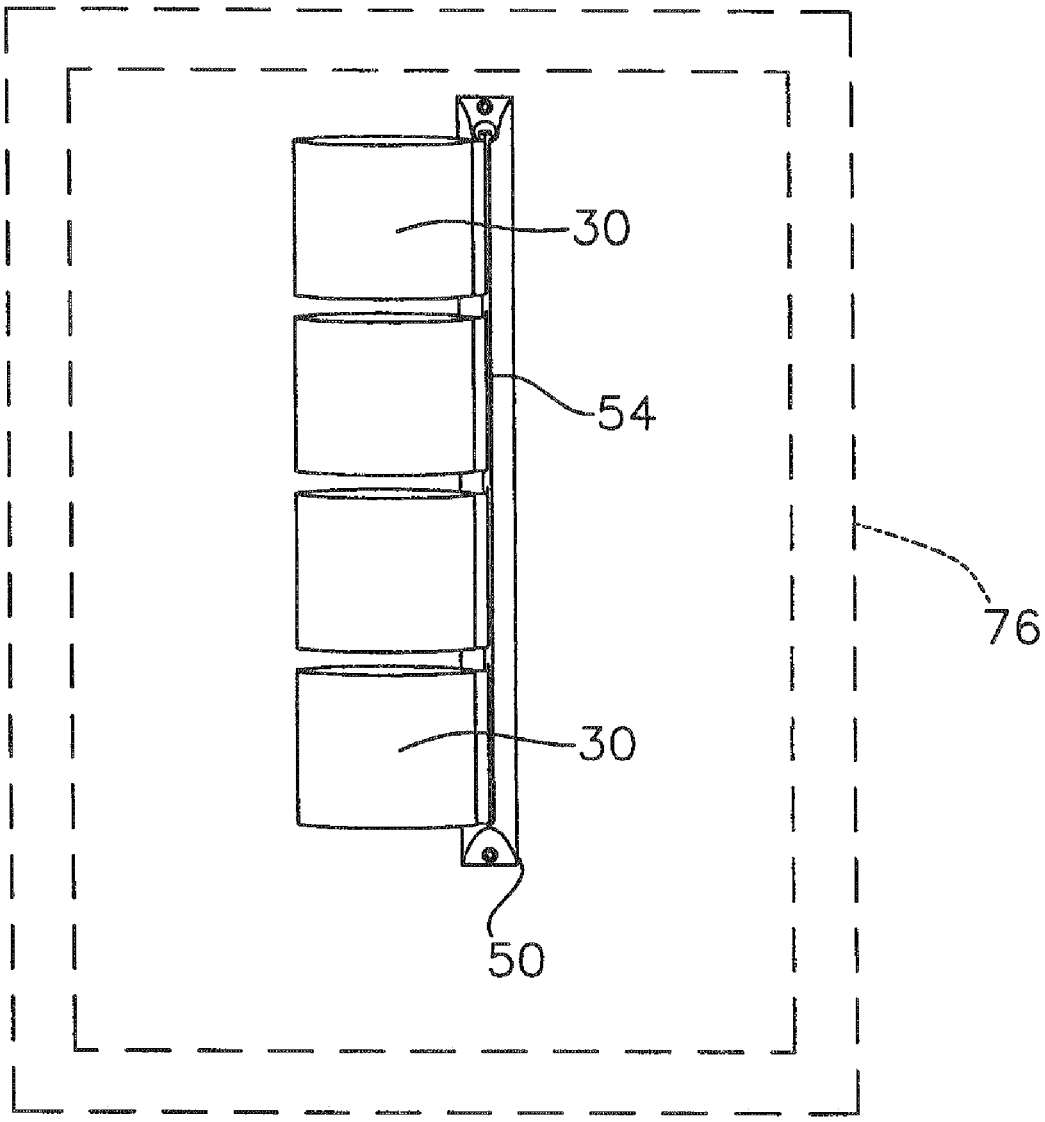
FIG. 12 depicts an example of an extended bracket for storage of multiple drink holders potentially such as on an inside kitchen cabinet door.
Figure 13:
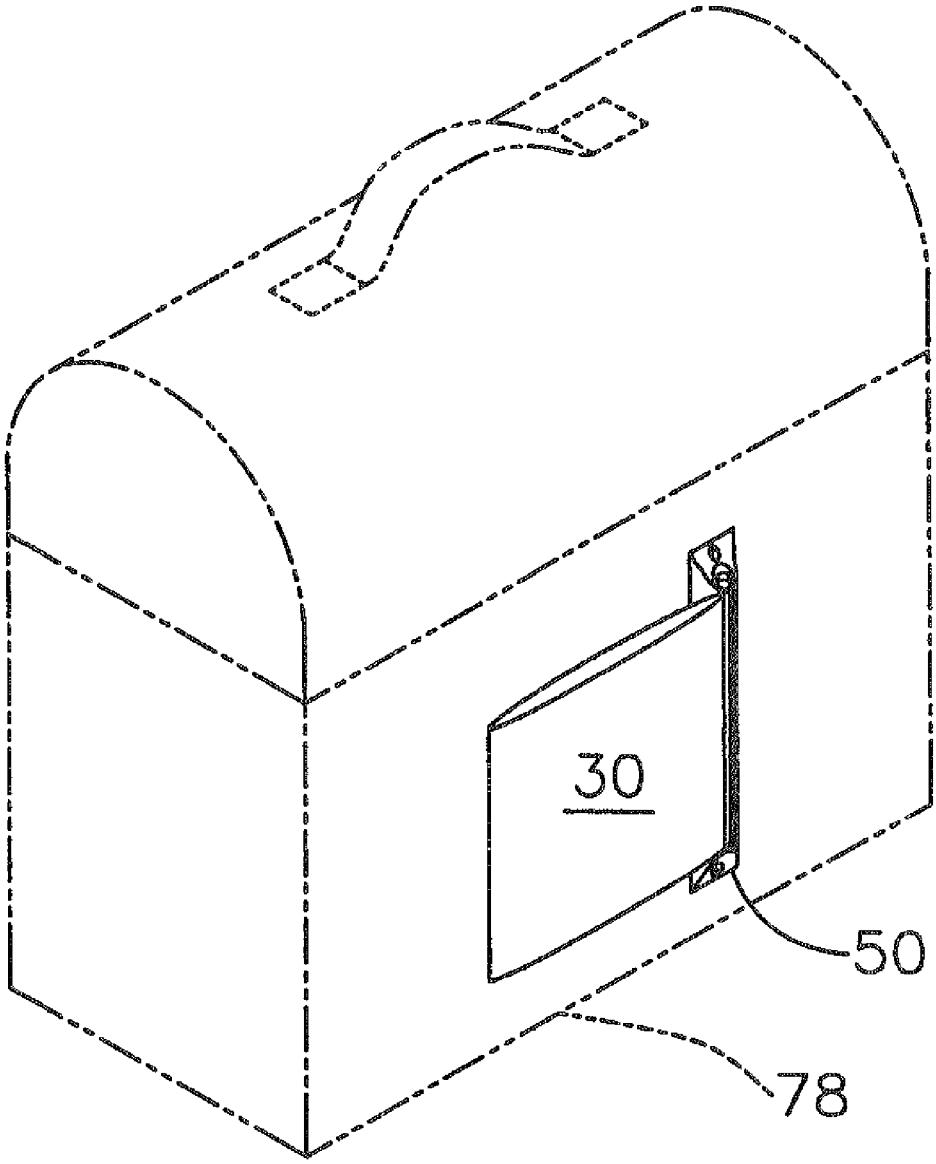
FIG. 13 depicts an example of a drink holder and storage bracket used with a lunch box.
Figure 14:
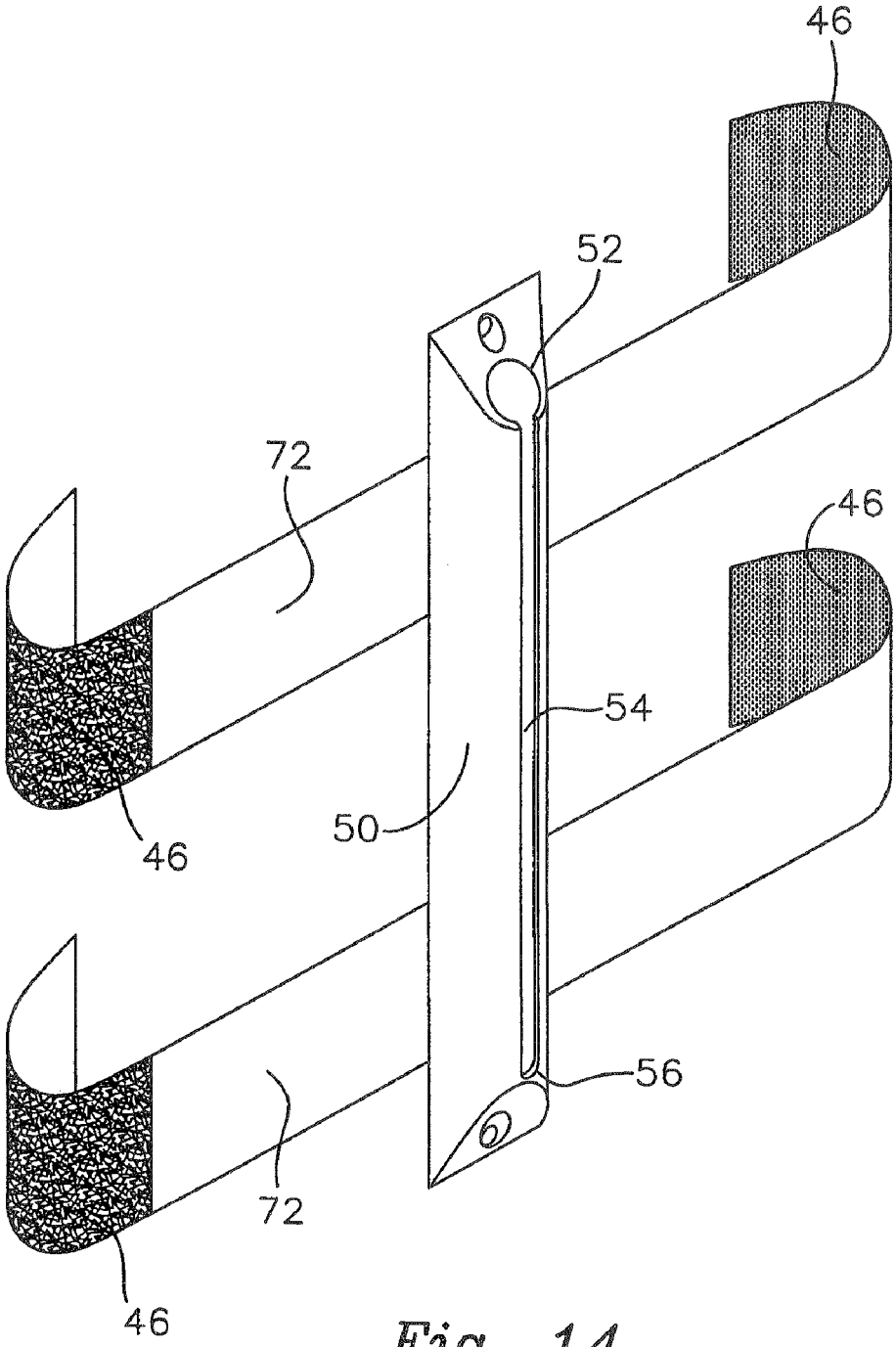
FIG. 14 is an example of an alternate method of mounting the bracket using straps that can be extended around a pole of other type of vertical member.

The vertical mounting bracket 50 is preferably made from polyvinyl chloride (PVC) a lightweight plastic material that is durable to the exterior environment. The bracket can be mounted to a flat vertical surface 70 with screws 60 through apertures 58,51 respectively. Also, other methods of attachment are contemplated for mounting the bracket 50 such as glue, adhesive, hook and loop fastening material 61 or other similar means. The bracket 50 can also be mounted to a pole with the use of straps 72 using hook and loop fastener means 46 such as depicted in FIG. 14 with the pole not shown. Examples of other flat surface surfaces 70 upon which the bracket 50 may be mounted are door surfaces 76, coolers 74, lunch box 78 and vehicle or boat inside panels 80 as shown in FIGS. 11-13.

The bracket top has a tapered portion 52 that allows the welt strip 32 located on the side of the beverage holder 30 to slide easily into the bracket channel 54. The channel 54 is preferably tapered to a smaller size channel after the first ½" of the top to prevent small fingers or objects from being placed in the channel 54. The bottom 56 of the bracket channel 54 is sealed or closed to prevent the welt strip 32 from sliding through and out of the channel 54. The bracket 50 may also be configured to hold two sleeves 30 side by side such as that depicted in FIG. 11 where there are two double brackets 50 mounted to the side of a cooler to facilitate the use of storing four beverage containers on the side of the cooler. The cooler 74 shown is representational of any surface upon which a bracket 50 with one or two channels 54 may be mounted.

Figure 2:
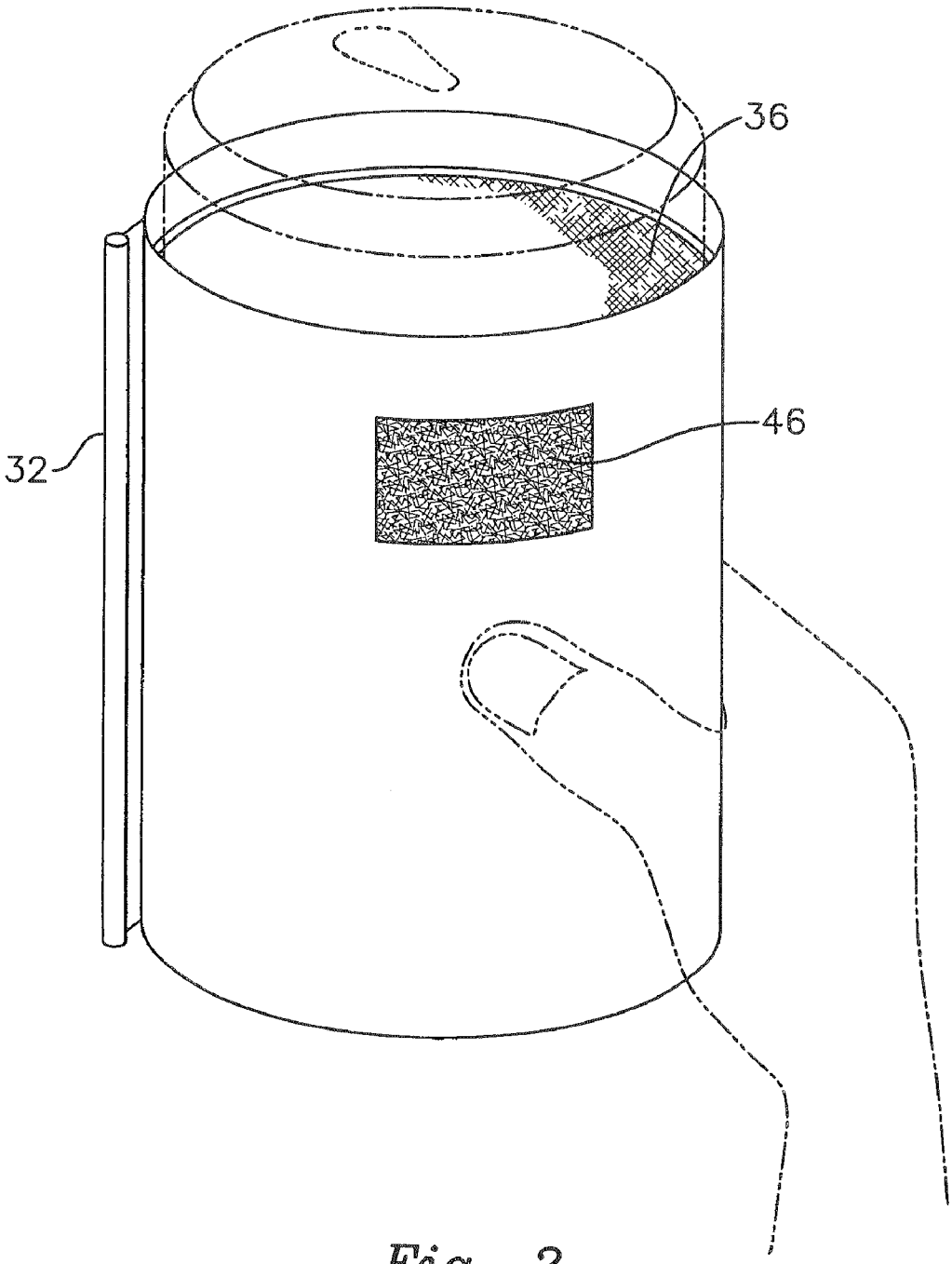
FIG. 2 is a back perspective conceptual view of the insulative sleeve portion of the invention.
Figure 3:
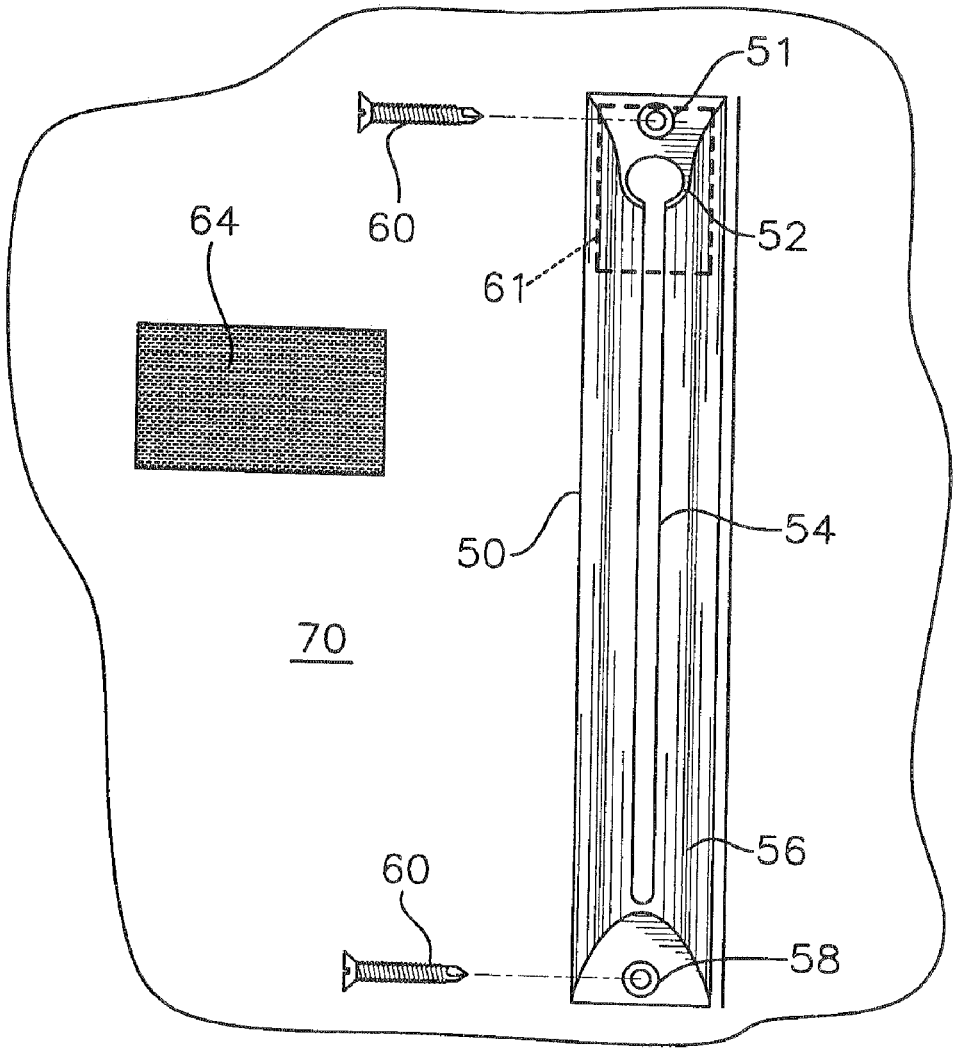
FIG. 3 is a conceptual view of a vertically oriented bracket with an example of an attachment means for the sleeve to an adjacent wall surface, that is, a corresponding hook and loop fastener component located adjacent to vertical bracket.
Figure 4:
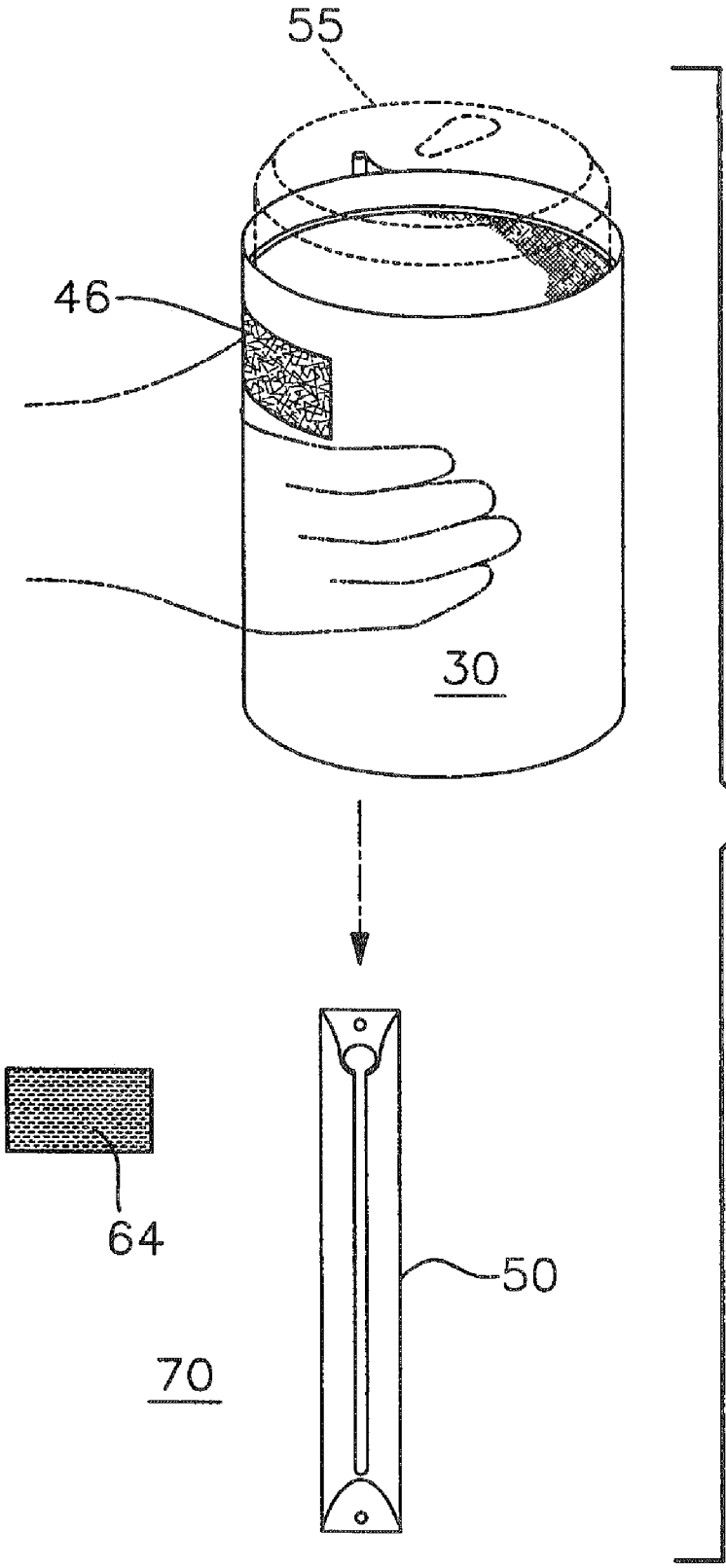
FIG. 4 is a perspective view of an example of the present invention in use.
Figure 5:
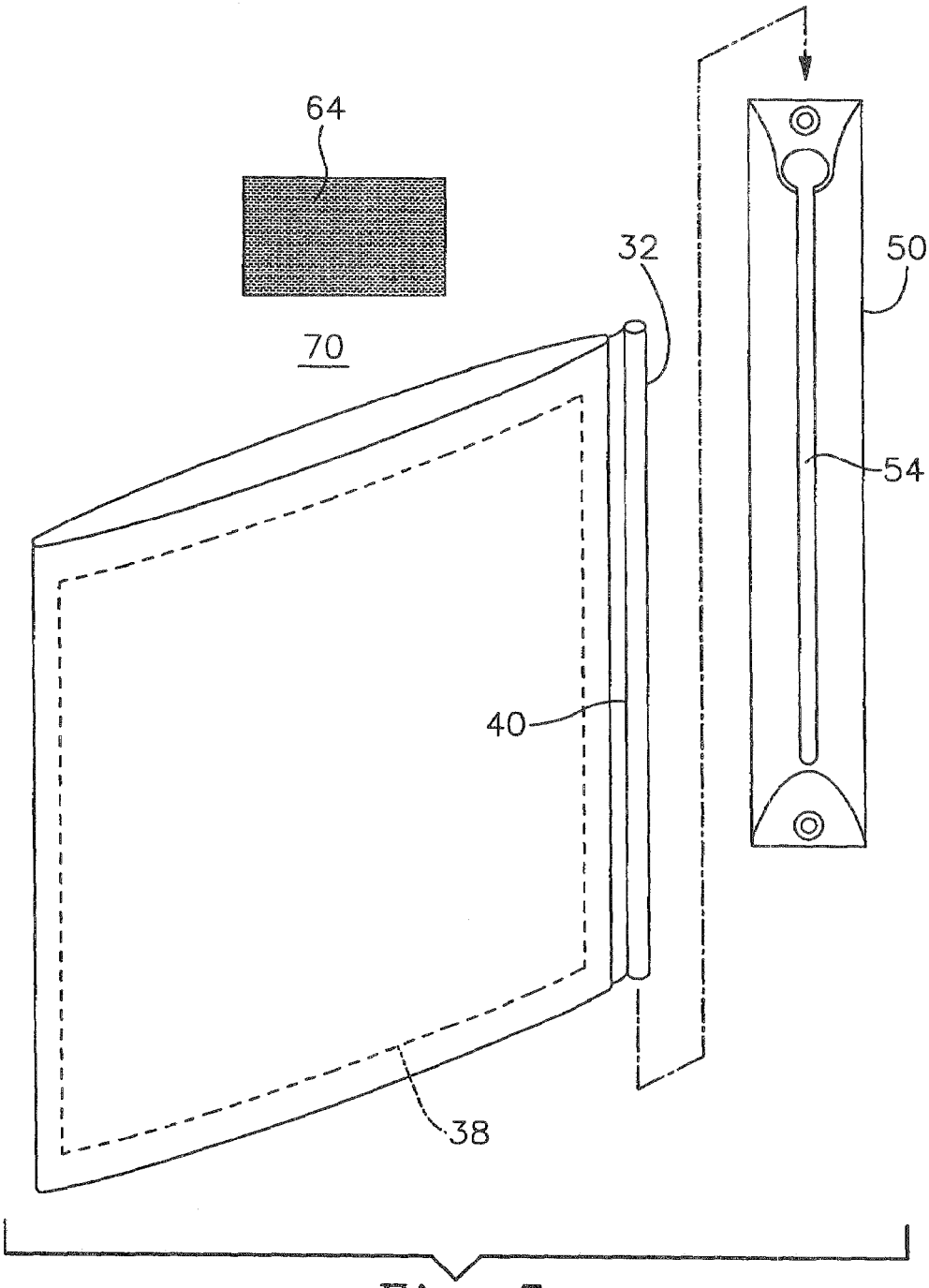
FIG. 5 is a conceptual view representing the placement of the beverage holder in to the bracket and into a flat storage configuration.
Figure 6:
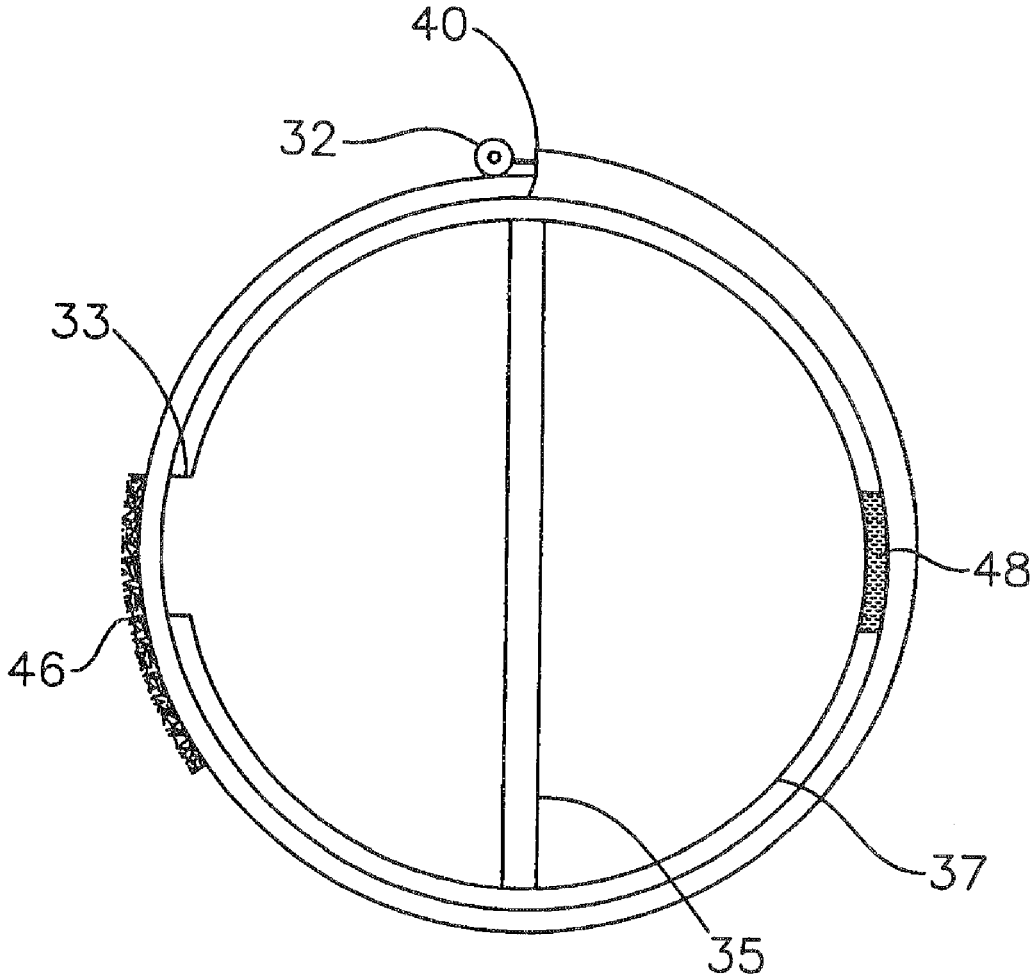
FIG. 6 is a top view of invention beverage holder portion or sleeve open for use.

Fastening means such as a patch of an appropriate mating side of a hook and loop fastening material 46 is applied on the back side of the beverage holder sleeve 30 in a position similar to that shown in FIG. 2. As seen in FIG. 3, an appropriately sized mating patch of open hook fastening material 64 is secured to the vertical surface 70 a short distance from the mounted bracket, whereby the holder may be secured flat for storage as shown in FIG. 5 (top view of drink holder) in the top view of the drink holder. In this position, the front side of the holder is exposed and can have decorative ornamentation 38, which is visible while stored flat. The decorative ornamentation is not a part of this application.

When the holder is in use, the loop fastener 46 that is applied on the back side of the insulated beverage holder also serves to improve grip by creating a place for the users thumb to rest just under the loop fastener. A loop fastener 46 stitched with a concave shape in the bottom can further improve the users comfort.

Figure 10:
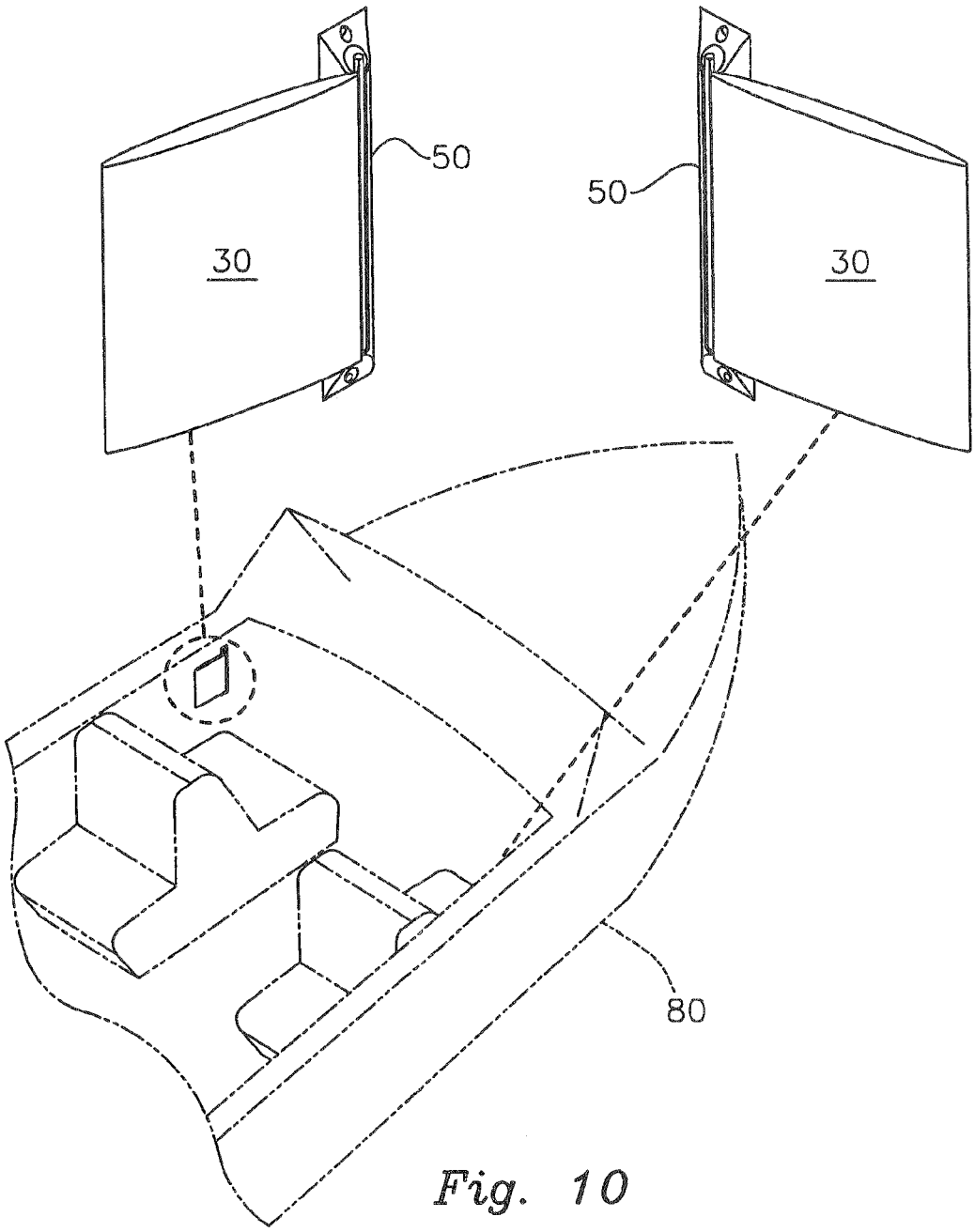
FIG. 10 is a mirror image view of the invention in storage positions used in a boat application.

When manufactured in a set of two for use in a boat or ice cooler, one beverage holder will be constructed and mounted as a mirror image of the other. See FIG. 10 as an example of such an installation. When manufacturing a set of four for household use, the bracket 50 could be larger to accept 2-4 drink holders stacked on one bracket as depicted in FIG. 12. In this application, the bracket 50 is only used for storage.

The insulated sleeve is formed with an opening at the top. The bottom aperture has an insulated base or piece 37 that includes a closed cell insulation layer 53 and a reflective film 36 on the inside of the sleeve 30 and a fabric/textile layer 37' underlying the insulation 53. This bottom piece 37 folds open as shown by the stitched fold line 35 in FIGS. 6 and 7, and prevents the beverage container 55 from sliding through the cylindrical insulated holder 30 and seals the bottom. The bottom piece 37 is permanently attached on one side (see 33 in FIG. 6) and can be attached on the other side in a plurality of ways including permanently sewn, use of hook and loop fastener (see mating fasteners represented by hook and loop 47,48 in FIG. 7) or other desired equivalent permanent and temporary fastening methods.

Figure 7:
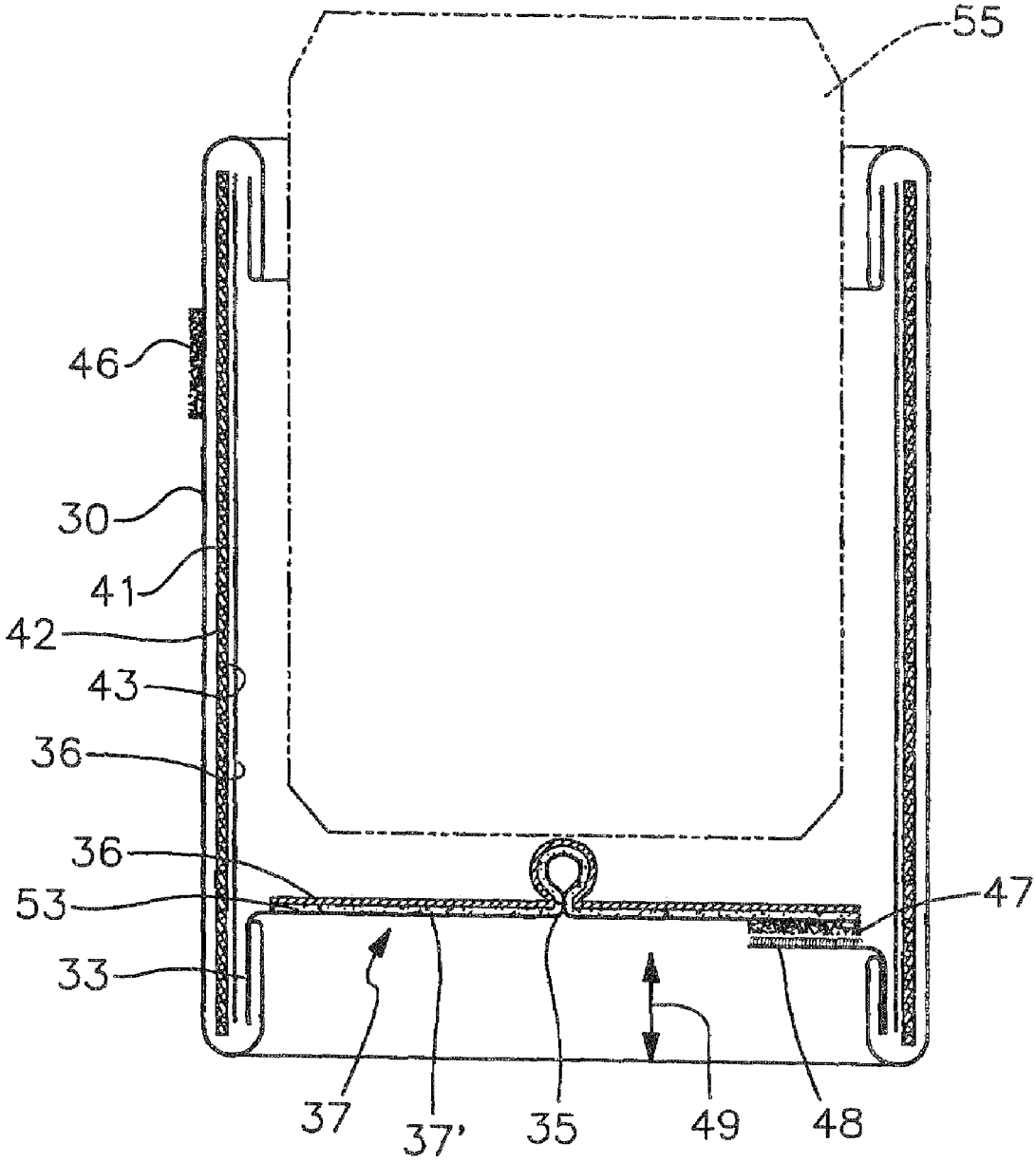
FIG. 7 is a front to back cross-section view of the invention (open and in use position)
Figure 8:
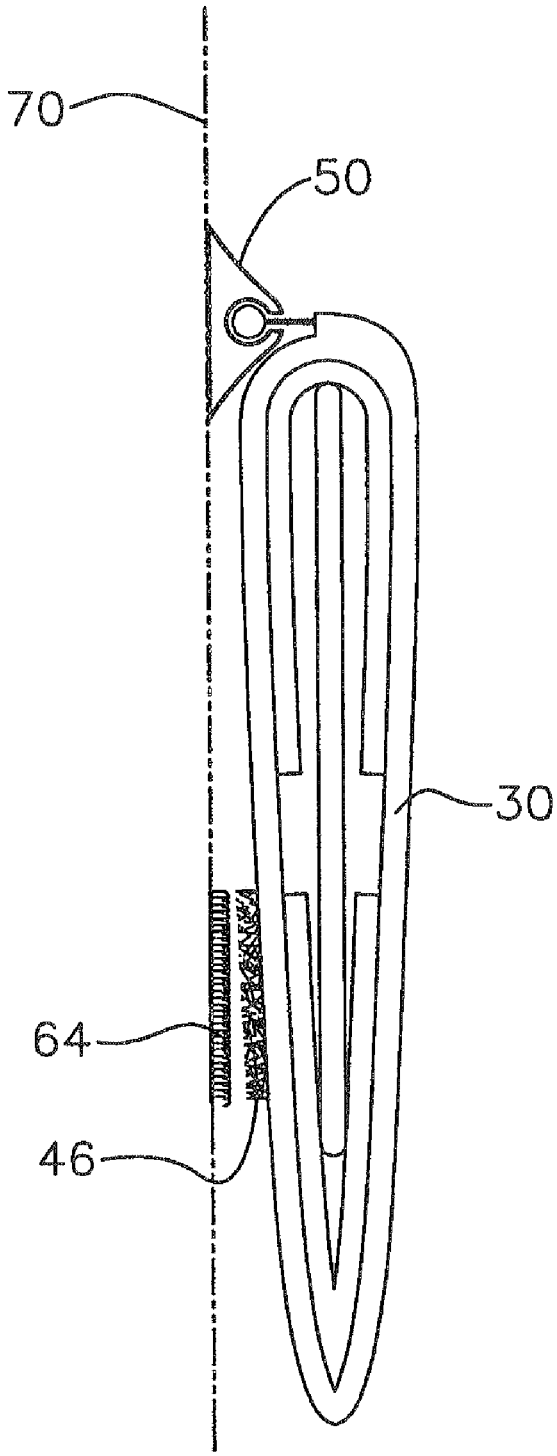
FIG. 8 is a top view of a drink holder in stored folded position.
Figure 9:
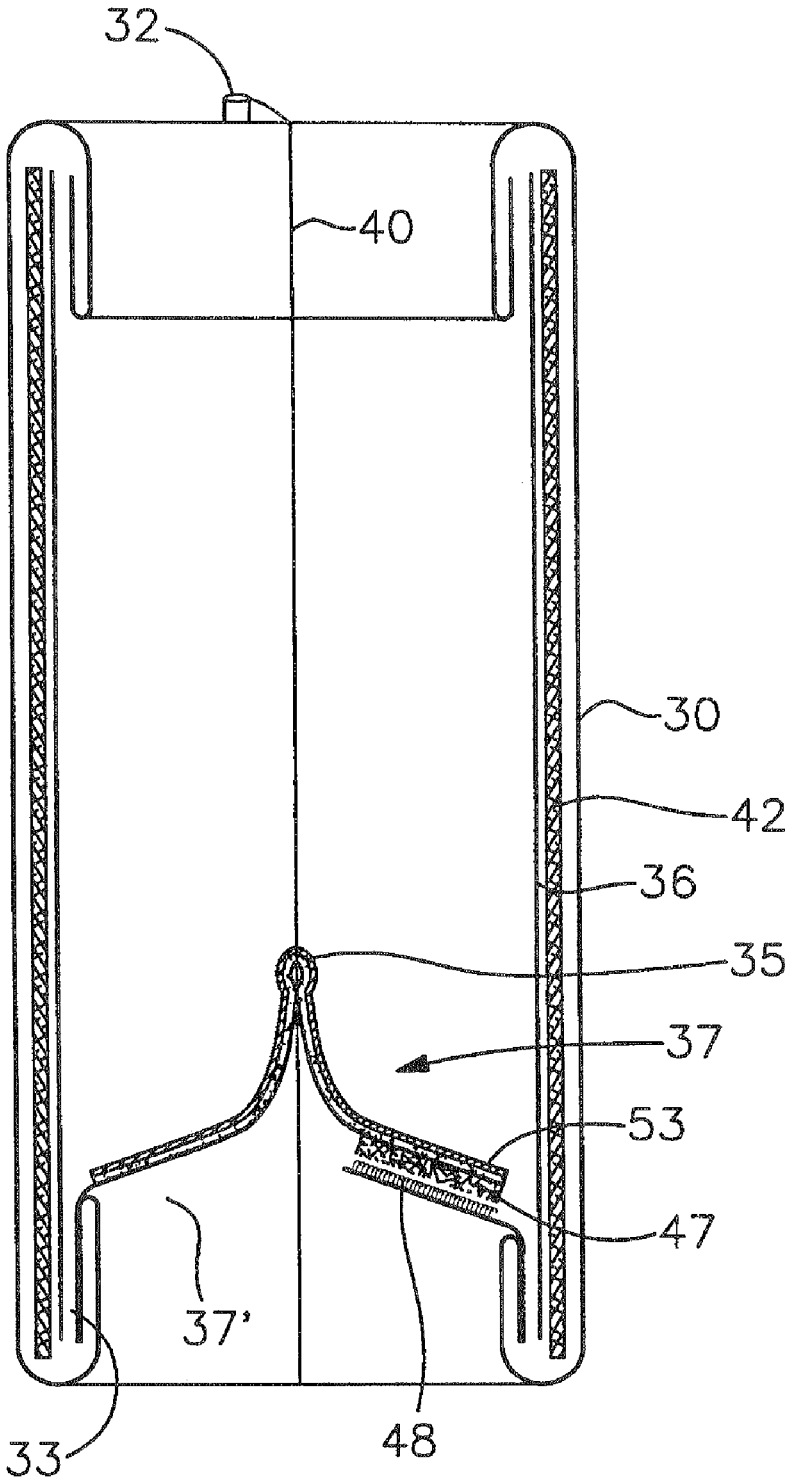
FIG. 9 is a cross-section view of an insulated drink holder in a semi-closed position.

As depicted conceptually in FIG. 9, a bottom circular insulative piece 37 is constructed so as to easily fold flat acts as the bottom of the device and is secured to the inside bottom on two sides as best shown in FIG. 9, that is, one side stitched into a bottom hem (see 33) and the other side adjustably and detachably connected using fasteners 47,48. The preferred method of securing the bottom insulative piece 37 is to stitch on one side and use hook and loop fastener to secure the second side. The bottom piece 37 preferred construction is of insulated material and fabric as described above. When the beverage container is inserted into the insulated sleeve 30, the container will push downwardly into the bottom piece 37 that will open into a circular base as shown in FIG. 7. The insulated beverage holder in this position, with a beverage container 55 in place will stand when placed on a flat surface. It should be noted that because the base is only secured on two sides at the bottom of the sleeve 30, it is easy to push up the beverage container 55 to remove it from the holder.

Stitching the bottom of the device includes the installation of the bottom insulative piece 37 which is attached on two sides of the sleeve 30. The insulation portion 53 may have reflective material on the inner surface of the bottom piece or on both the inner and outer surfaces of the bottom piece 37 similar to the insulation material incorporated into the sleeve 30. As shown in FIG. 7, the bottom piece 37 may be located within the sleeve 30 so as to allow a gap 49 between a surface that the invention may be placed on and the bottom of the beverage container 55 thus creating an air space to reduce heat transfer to the beverage container 55. It should be noted that for exterior use, the material from which the device is constructed is resistant to sun, provides good insulative qualities, and resistant to mildew. It should be noted that closed-cell foam with reflective surface is the preferred insulating materials however other insulation could be used for the insulating material depending on the end application. Selection of the insulation type may differ based on the proposed application, i.e. closed cell foam works well in a marine environment and provides the ability of the beverage holder to float. The reflective surface on the insulation improved the function of the devise to keep the can beverage cold.

A welt strip material 32 as depicted in FIG. 5 is sewn into the seam side 40 of the cylindrical sleeve 30 to be used for holding the beverage 55 in an upright position and/or storing the beverage holder in a compact position. The welt material 32 should be resistant to the sun and mildew.

To store the device, slide the beverage holder welt 32 into the vertical bracket channel 54 and fold the device flat against the vertical surface 70 that has a small piece of hook and loop fastener material 64 secure approximately 1½ inches from the bracket. Press the back of the drink holder that has a corresponding mating hook and loop fastener material 46 to fastener material 64 mounted on the vertical surface 70 and the drink holder will be held in a flat storage position. Of course, the folded sleeve attached to an adjacent surface is depicted by way of example only. Other equivalent means know in art are contemplated such as snap buttons, magnets, or other similar methods (not shown).

This insulated beverage holder sleeve may include an exterior surface portion 38 on which decorative ornamentation, logos, charms, names, etc. may be incorporated.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A beverage holder device comprising:

a flexible foldable cylindrically-shaped insulated sleeve with a straight longitudinal side fabric seam that includes a flexible piping or welt sewn into the straight longitudinal fabric seam and a bulbous portion of the welt being in a spaced-apart parallel relationship to said fabric seam, said piping or welt being configured so as to form a beaded edge sized to slidingly engage into an accepting bracket with a longitudinal tubular shaped furrow and a smaller channel opening running a predetermined length of said bracket wherein said channel opening is smaller in width opening than a cross-section dimension of said beaded edge portion of said piping or welt;

a circumference of the tubular shaped furrow being larger than a radius of the beaded edge of the piping or welt so when said sleeve is joined with said bracket, said sleeve is held in a non-rigid fixed position and said sleeve moves to each side of the bracket;

the piping or welt having a flat portion configured so that when said bulbous portion is inserted within said bracket, said flat portion extends from said bulbous portion through said channel opening to said fabric seam and is integrally attached to said sleeve by said fabric seam;

said sleeve having an inside diameter sized to receive and hold a beverage container;

a foldable circular bottom portion for preventing said beverage container from dropping through said sleeve, said bottom portion being attachable to said sleeve in a spaced-apart overlying relationship to a bottom edge of said sleeve to form a gap between said bottom edge and said bottom portion when said beverage container is inside said sleeve, said bottom portion further having an upwardly directed elevated portion that substantially runs diagonally across a central portion of said bottom portion to form an air gap between said bottom portion and a beverage can bottom;

said bracket having means for mounting said bracket to a vertical surface; and said bracket having a closed bottom end and an opening at its upper end, said channel being sized to receive by sliding engagement therein said piping or welt wherein said piping or welt and said channel opening are configured such that when said piping or welt is slid into said channel starting from said channel's upper end, said sleeve is held vertically in place by said bracket.

2. The device according to claim 1, wherein said insulated sleeve further comprises an insulation material and an outer fabric material, said insulation material further having an reflective material layer on an outer layer of said insulation material which faces outward to reflect heat and prevent radiant heat transfer, an inner surface of said insulation material or on both an inner and outer surface of said insulation material.

3. The device according to claim 2, further comprising an inner fabric liner within the interior of said sleeve or an interior finish surface attached to an insulation reflective material.

4. The device according to claim 2, wherein the insulation reflective material is made from a closed cell foam material.

5. The device according to claim 2, wherein said fabric material is hemmed and attached to said bottom portion of said sleeve a predetermined distance inwardly from a bottom edge of said sleeve so as to allow a generally uniform spaced gap between said bottom edge of said sleeve and said bottom portion when said beverage container is placed in said sleeve.

6. The device according to claim 1, wherein said foldable bottom portion further comprises an insulation material with a reflective material layer on an outer surface of said bottom portion insulation material or on both an inner surface and said outer surface of said bottom portion insulation material.

7. The device according to claim 6, further comprising a layer of fabric material sewn together to create one underlying said bottom portion.

8. The device according to claim 1, wherein said bottom portion is tangentially attached on two sides to said sleeve or is tangentially attached to one side of said sleeve and detachably attached on another side of said sleeve.

9. The device according to claim 8, wherein said bottom portion is detachably attachable on said another side to said sleeve with corresponding mating hook and loop fasteners.

10. The device according to claim 1, wherein said sleeve further comprises means for temporary attachment of a folded sleeve engaged with said bracket to a surface area adjacent to said engaged sleeve.

11. The device according to claim 1, wherein said elongated bracket is of sufficient length to sequentially engaged said piping or welt material of two or more sleeves.

* * * * *